US007007475B2

(12) United States Patent
Nguyen et al.

(10) Patent No.: US 7,007,475 B2
(45) Date of Patent: Mar. 7, 2006

(54) CONICAL HELICAL OF SPIRAL COMBUSTOR SCROLL DEVICE IN GAS TURBINE ENGINE

(75) Inventors: Ly D. Nguyen, Phoenix, AZ (US); Hakan Aksoy, Tempe, AZ (US); Stony Kujala, Tempe, AZ (US); Cristopher Frost, Scottsdale, AZ (US)

(73) Assignee: Honeywell International, Inc., Morristown, NJ (US)

( * ) Notice: Subject to any disclaimer, the term of this patent is extended or adjusted under 35 U.S.C. 154(b) by 179 days.

(21) Appl. No.: 10/386,771

(22) Filed: Mar. 11, 2003

(65) Prior Publication Data

US 2005/0188698 A1 Sep. 1, 2005

(51) Int. Cl.
*F02C 1/00* (2006.01)
*F02G 3/00* (2006.01)

(52) U.S. Cl. ..... 60/722; 60/752; 60/804; 60/805; 415/205

(58) Field of Classification Search ..... 60/722, 60/805, 804, 752, 800; 415/205, 204, 184, 415/218.1
See application file for complete search history.

(56) References Cited

U.S. PATENT DOCUMENTS 3,186,685 A * 6/1965 Desbaillets et al. ..... 415/208.3
3,837,760 A * 9/1974 Stalker ..... 415/181
3,994,620 A * 11/1976 Spraker et al. ..... 415/145
4,129,985 A * 12/1978 Kajita et al. ..... 60/39.37
4,177,006 A * 12/1979 Nancarrow ..... 415/151
4,429,527 A * 2/1984 Teets ..... 60/776
4,512,716 A * 4/1985 McHenry et al. ..... 415/205
4,544,326 A * 10/1985 Nishiguchi et al. ..... 415/151
4,573,315 A * 3/1986 Stroem ..... 60/39.37
5,266,033 A * 11/1993 Rogers et al. ..... 434/226
5,317,865 A * 6/1994 Inoue et al. ..... 60/804
6,269,647 B1 * 8/2001 Thompson et al. ..... 60/748
6,302,647 B1 * 10/2001 Schueler et al. ..... 415/184
6,305,172 B1 * 10/2001 Kim ..... 60/760
6,307,278 B1 * 10/2001 Nims et al. ..... 290/52
6,629,414 B1 * 10/2003 Fischer ..... 60/723

FOREIGN PATENT DOCUMENTS

JP 3-11128 * 1/1991
JP 9-41989 * 1/1995
JP 10-220760 * 2/1997
JP 2002-450103 * 10/2000
JP 2001-343123 * 12/2001

* cited by examiner

*Primary Examiner*—William H. Rodriguez
(74) *Attorney, Agent, or Firm*—Robert Desmond, Esq.

(57) ABSTRACT

A conical helical design for a turbine combustor scroll utilizes as much cavity of the combustor housing as possible by adding an axial shift and an irregular cross sectional shape in the scroll without adversely effecting aerodynamic performance. The axial shift region of the combustor scroll extends the cross-sectional area centroid of the scroll beyond the scroll's discharge area B-width. The resulting scroll design allows for the use of a high performance engine with a larger combustor while reducing the weight of the system by making the combustor housing as small as possible. Furthermore, the scroll design increases the air velocity for convection cooling by reducing the gap between the scroll and the housing. The turbine scroll of the present invention is useful in engines for which high performance is required, such as certain high performance aircraft.

28 Claims, 4 Drawing Sheets

CONICAL HELICAL OF SPIRAL COMBUSTOR SCROLL DEVICE IN GAS TURBINE ENGINE

GOVERNMENT RIGHTS

This invention was made with Government support under contract number N00019-02-C-3002 awarded by the U.S. Navy. The Government has certain rights in this invention.

BACKGROUND OF THE INVENTION

The present invention generally relates a conical helical concept of a spiral combustor scroll within the combustion system of a gas turbine engine. More specifically, the present invention relates to a scroll designed to utilize as much cavity of combustor housing as possible, and largest possible liner by adding an axial shift and an irregular cross sectional shape in the scroll without adversely effecting aerodynamic performance.

A combustor scroll in a turbine engine is used to deliver the exhaust gases of combustion in such a manner as to drive a turbine. A conventional combustor scroll has a spiral spline attached to a cylindrical or elliptical shape with an air inlet at zero degrees while the air exhaust typically discharges radially or axially toward the inner diameter. A material capable of withstanding high temperatures is usually used to fabricate the body through a forming process or cast. The center of the scroll's cross-sectional area, also known as the cross-sectional area centroid, is not allowed to axially cross the center plane of the "B-width", or combustion exhaust product discharge area. This conventional concept, however, is adequate for only low cycle, low performance and less weight driven engines.

U.S. Pat. No. 3,837,760 discloses a turbine engine that employs an axial type compressor that uses a scroll curvature design to change air particle flow velocities through various vane angle arrangements. See B, D and U in FIG. 8. A multiple component system accelerates the flow to supersonic speeds with a chiefly peripheral discharge and tubular diffuser to receive the supersonic flow.

U.S. Pat. No. 5,266,033 discloses a centrifugal compressor collector in which the radial cross-sectional area of the housing progressively changes. This progressive change is due to the variation of the housing's axial height as shown in FIGS. 3 through 8 of the patent. The axial shift affects only one common side of the rectangular shape, circumferentially around the housing. The axial shift of the cross-sectional area's center of gravity is progressive and remains on one side of the B-width.

U.S. Pat. No. 5,317,865 discloses a turbine engine design that utilizes an inline combustor integral with the turbine scroll to minimize radial height of the engine. The inline combustor/scroll also minimizes the pressure drop of the combustor inlet air by eliminating the turns associated with a reverse flow can style combustor. The combustor is spiral shaped and positioned between the compressor and turbine which allows the direction of flow of air or working gas to remain substantially unchanged from the compressor to the turbine.

As can be seen, new engine designs have resulted in new technical challenges that require an improved turbine scroll shape. Such a turbine scroll must have the ability to accommodate a larger liner than usual due to emergency starting requirements. The liner and scroll must utilize as much cavity in the combustor housing as possible without adversely effecting performance. This allows a smallest possible combustor housing design and therefore reduce the weight of the entire system.

SUMMARY OF THE INVENTION

In one aspect of the present invention, a combustor scroll of a turbine engine comprises an air inlet; a combustion exhaust product discharge area having a B-width; and an axial shift region providing a portion of the combustor scroll to have an irregular cross-sectional area with its centroid passing beyond the B-width.

In another aspect of the present invention, a combustor scroll of a turbine engine comprises an air inlet; a combustion exhaust product discharge area having a B-width; and an axial shift region providing a portion of the combustor scroll to have an irregular cross-sectional area centroid passing beyond the B-width; wherein the combustor scroll has a substantially helical configuration; and the combustor scroll has a substantially conical shape with a cross-sectional area decreasing from the air inlet to the air discharge.

In yet another aspect of the present invention, a turbine engine comprises a combustor scroll having an air inlet; a combustion exhaust product discharge area having a B-width; and an axial shift region providing a portion of the combustor scroll to have a cross-sectional area centroid passing beyond the B-width.

In a further aspect of the present invention, a turbine engine comprises a combustor scroll having an air inlet, a combustion exhaust product discharge area having a B-width, and an axial shift region providing a portion of the combustor scroll to have a cross-sectional area centroid passing beyond the B-width, wherein the combustor scroll has a substantially helical configuration; and the combustor scroll has a substantially conical shape with a cross-sectional area decreasing from the air inlet to the air discharge.

In still a further aspect of the present invention, a method for making a turbine engine, comprises attaching a first, air inlet end of a combustor scroll to a combustor liner of the turbine engine; attaching a second, opposite end of the combustor scroll to a combustion exhaust product discharge area having a B-width; providing an axial shift region in the combustor scroll, the axial shift region resulting in a portion of the combustor scroll having a cross-sectional area centroid passing beyond said B-width.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a turbine combustor scroll designed to utilize as much cavity of combustor housing as possible by adding an axial shift and an irregular cross sectional shape in the scroll without adversely effecting aerodynamic performance. The resulting scroll design reduces the weight of the system by making the combustor housing as small as possible while providing more space for installation and accommodating a larger liner. Moreover, a combustor scroll having an irregular cross-sectional area is designed to allow for a larger air flow, as compared to conventional scrolls, without adversely affecting the output gas characteristics, such as velocity and volume. Furthermore, the scroll design increases the air velocity for diffusion cooling by reducing the gap between the scroll and the housing, thus causing the same amount of air to flow through a smaller area. The turbine scroll of the present invention is useful in engines for which high performance is required, such as certain high performance aircraft.

Conventional turbine scrolls have a spiral spline attached to a cylindrical or elliptical shape with a combustion exhaust gas inlet at a reference angle of zero degrees while the air exhaust typically discharges radially or axially toward the inner diameter. The centers of the scroll's cross-sectional areas are often not allowed to pass through the system "B-width", which is well-understood by those skilled in the art as the area of combustion exhaust product discharge from the turbine scroll. As is well known by the skilled artisan, the B-width is important because it sets the vane throat area and sets the amount of airflow to the turbine; the B-Width dimension is defined according to the Mach Number criteria for optimizing the system operational efficiency. This conventional concept, however, is adequate only for a low cycle, low performance and less weight driven engines.

Figure 1:
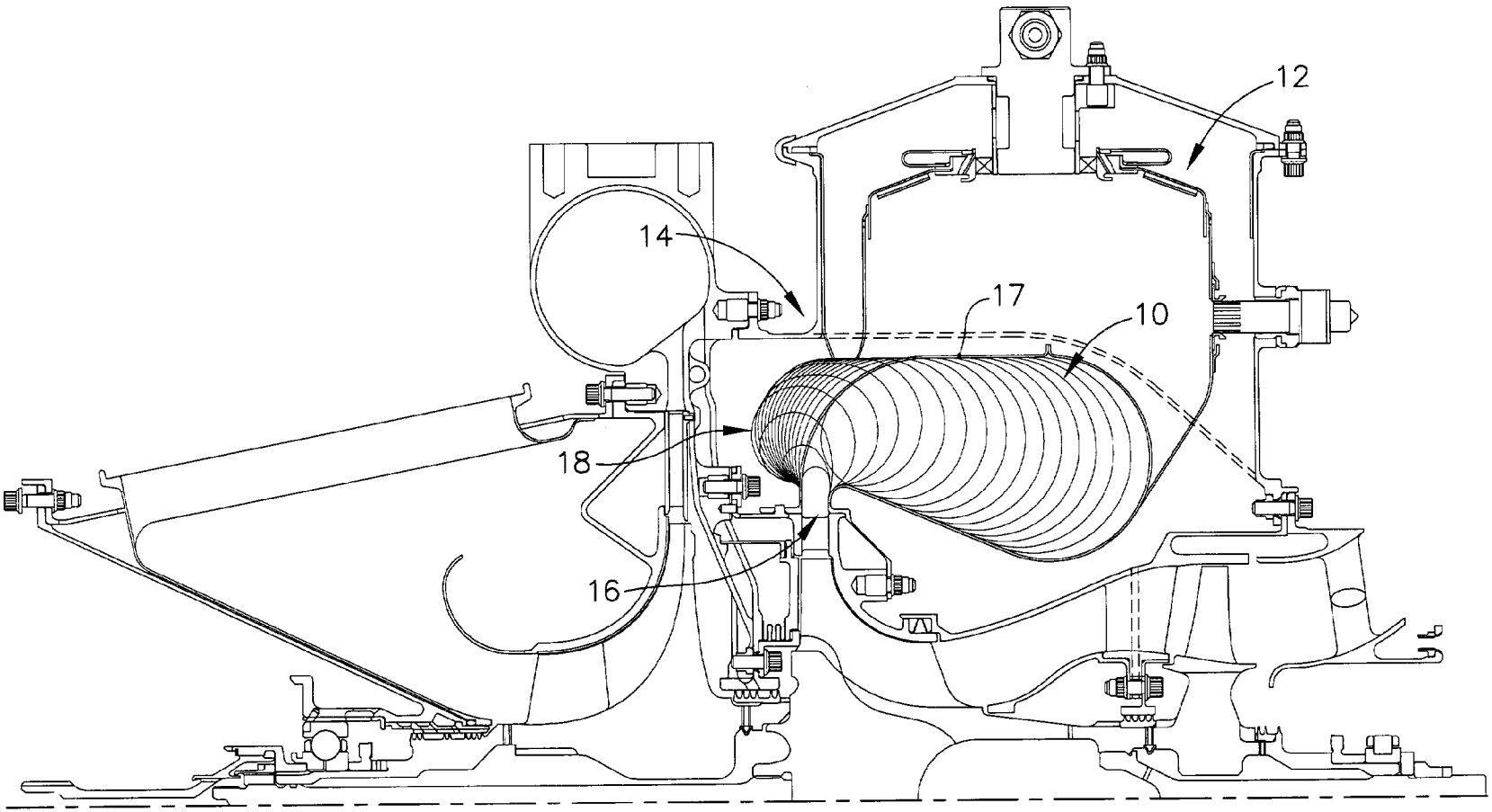
FIG. 1 is a partial cross sectional view of the power section of a gas turbine engine of the present invention.

Referring to FIG. 1, there is shown a partial cross sectional view of the power section of a gas turbine engine of the present invention. A turbine scroll 10 to may be in communication with a combustor liner 12 wherein the combustion may take place. Air may enter the combustor liner through air inlet 20 and the combustion products may exhaust into turbine scroll 10 through a combustion exhaust inlet 11. A combustor housing 14 may cover turbine scroll 10 and combustor liner 12. A combustion exhaust product discharge area, also known as a B-width, 16 may attach to turbine scroll 10 at the end opposite that of combustor liner 12. The helical design of turbine scroll 10 gives turbine scroll 10 a gradual helical shape to form an axial shift region 18, a region of turbine scroll 10 that is shifted along the axis through which the scroll spirals (the x-axis in FIG. 3). Axial shift region 18 causes the cross-sectional area centroid of a portion of turbine scroll 10 to pass beyond B-width combustion exhaust product discharge area 16. The axial shift region may be useful to provide for additional scroll volumes and a larger liner which may be useful during emergency starts of some turbine engines. Note that this may result in combustion exhaust product discharge area 16 also being axially shifted along the x-axis (see FIGS. 2 and 4).

Axial shift region 18 combined with an irregular cross sectional area with a flat curve portion 17 may be formed at a location in said turbine scroll 10 such that the axial shift region 18 and overall diameter can be smaller and may occupy a space that was previously unoccupied by the same engine with a conventional turbine scroll. In other words, the addition of axial shift region 18 may not increase the size of the cavity required within combustor housing 14, thus not requiring a larger combustor housing 14 and not requiring additional size or weight. Moreover, the occupation of such previously empty space results in an increase in air velocity for diffusion cooling of the exterior of turbine scroll 10 by reducing the gap between turbine scroll 10 and combustor housing 14. This increased air flow may be useful to help regulate the temperature of turbine scroll 10, as the larger sized combustor of a high performance turbine engine may generate heat greater than that of a conventional engine. Additional cooling may help regulate the temperature of the air at discharge area 16 to be similar to that of a conventional engine, thus removing any requirements to make downstream changes in design from that of a conventional turbine engine.

Figure 2:
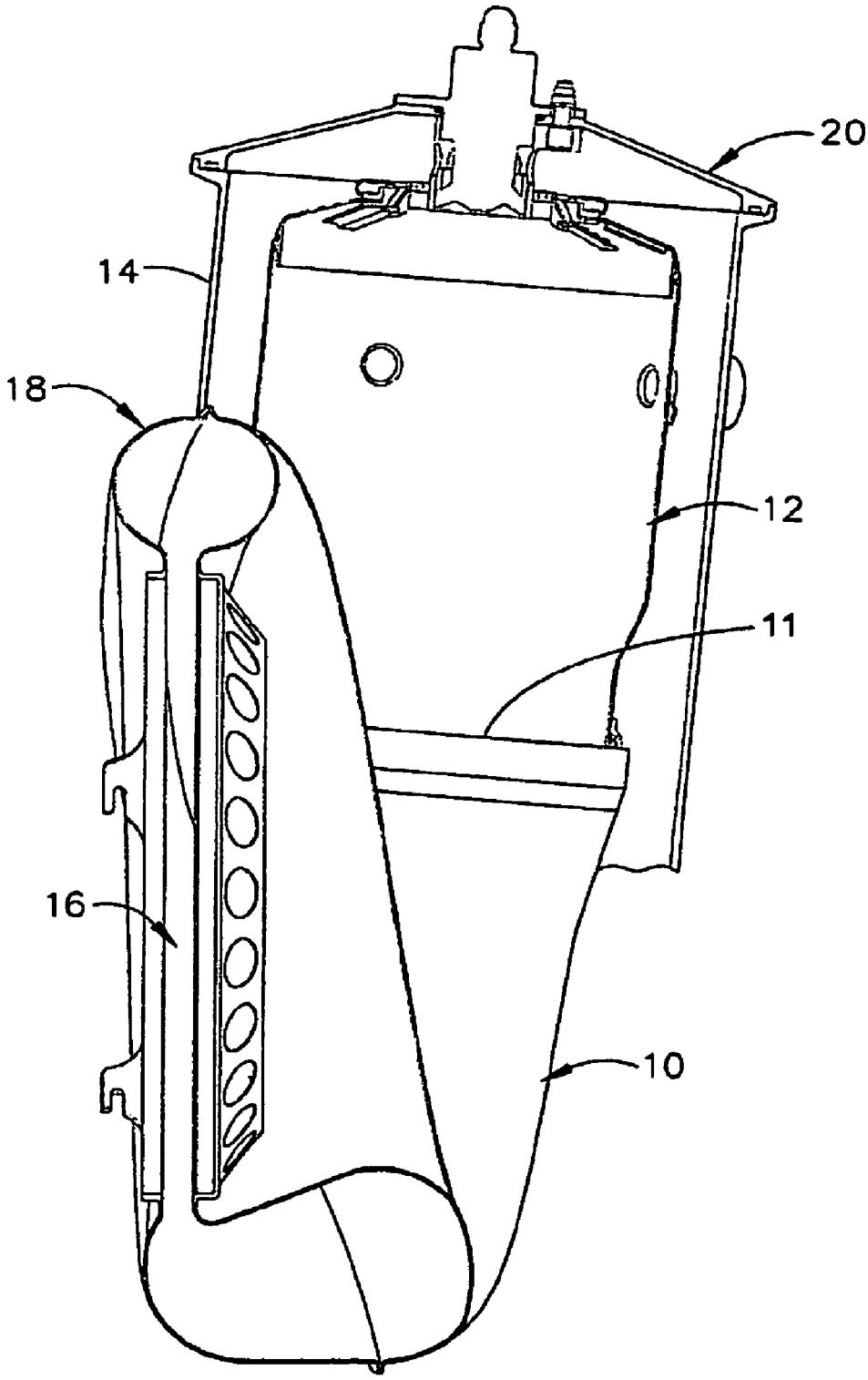
FIG. 2 is a perspective view of the combustor scroll used in the gas turbine engine of FIG. 1.

Referring now to FIG. 2, there is shown a perspective view of the combustor scroll used in the gas turbine engine of FIG. 1. Turbine scroll 10 has a combustion exhaust inlet 11. A portion of turbine scroll 10 may be helically offset to form axial shift region 18. This offset is advantageous in that it provides a turbine scroll that is able to accommodate a larger liner as compared to a conventional scroll without such an offset axial shift region. Such a consideration is useful, for example, in emergency starts, when high performance of the turbine engine is critical. Axial shift region 18 may be designed to use existing space in the cavity formed by combustor housing 14. Therefore, the additional air flow required for high performance engines may be obtained without increasing the weight of the system. Without axial shift region 18 and irregular cross sectional areas 24 with flat curve portion 17, a larger turbine scroll would be necessary to accommodate the scroll requirements for a high performance gas turbine engine. Such a larger turbine scroll would result in the need for a larger engine size, including a larger combustor housing, thereby increasing the weight of the engine.

Figure 3:
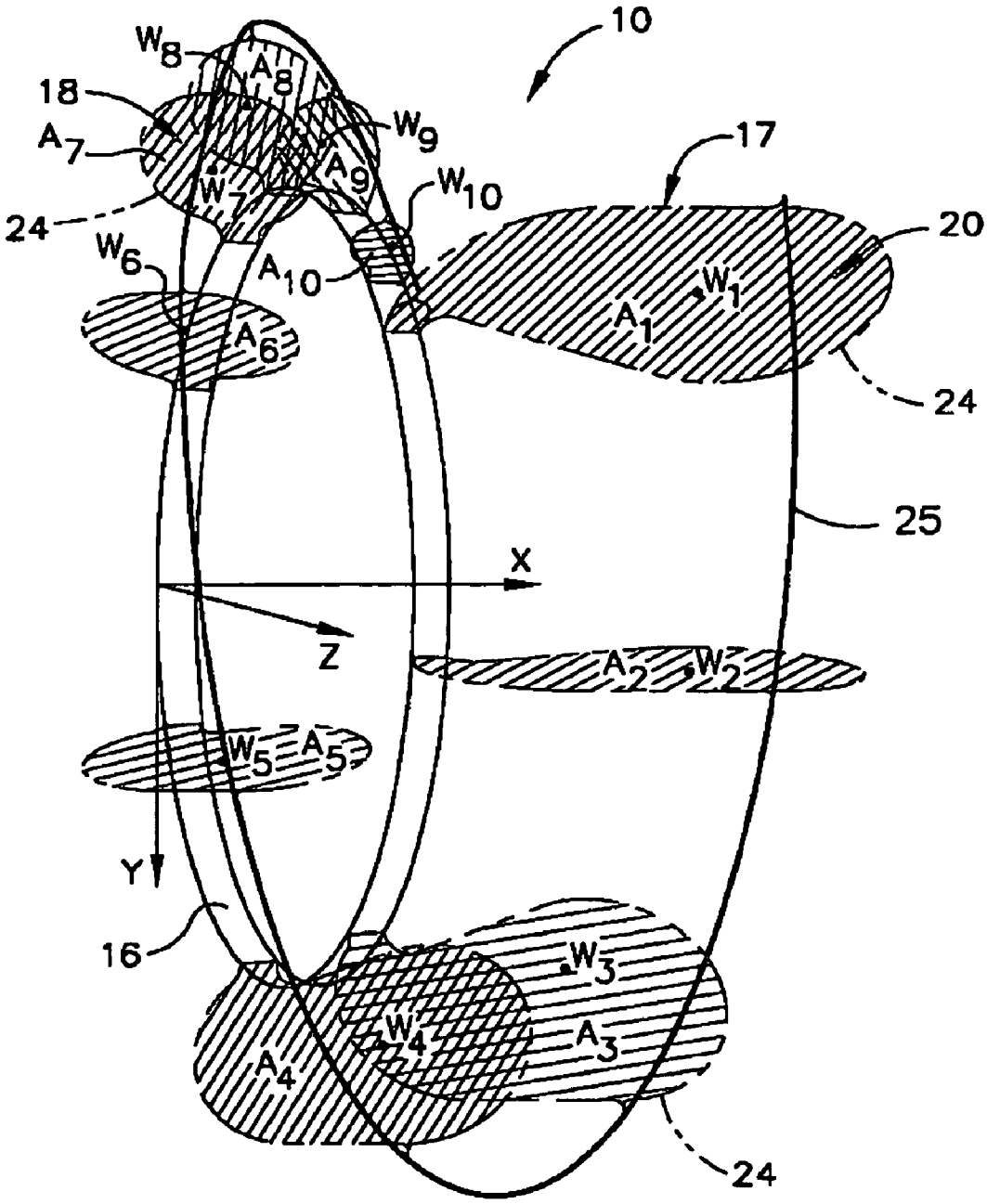
FIG. 3 is a schematic view of the conical helical concept of the combustor scroll of FIG. 2.

Referring now to FIG. 3, there is shown a schematic view of the conical helical concept of the spiral turbine scroll 10 of FIG. 2. The figure shows the helical shape and irregular cross-sections 24 throughout selected portions of turbine scroll 10. In addition to occupying previously unoccupied space within combustion housing 14 as stated above, it can be seen how irregular cross sections 24 may also accommodate the axial shift of combustion exhaust product discharge area 16. Combustion exhaust enters turbine scroll 10 through combustion exhaust inlet 11. Axial shift region 18 gives a cross-sectional area centroid that passes beyond the combustion exhaust product discharge area 16. The cross-sectional area at combustion exhaust inlet 11 may be larger than the total cross-sectional area at discharge area 16. Turbine scroll 10 may, if it could be straightened, form a conical shape from combustion exhaust product discharge area 16 at the top to combustion exhaust inlet 11 as the larger base of the conical shape. The irregular cross-sectional areas are shaded and defined as A1 to A10 in FIG. 3. In theory, there are finite cross sectional areas that can be generated by intersecting a plane normal to the helical spline 25 that defines the helical shape of the scroll. Each irregular cross sectional area dictates the airflow requirement and is bounded by curves, lines, and the spline 25. The area centroid which is also known as the area center of gravity is defined as a point on an area in which all forces acting on it are in equilibrium. These points are defined as "Wn" in FIG. 3. These points may be on either side of the B-width. For example, the centroid area passing beyond the B-width in cross-sections A1 to A6 are designated W1 to W6 and are shown on the aft side of the B-Width 16, while any cross sectional areas from A7 to A10 will be on the forward side of the B-width (16). Each cross sectional area has its own area centroid.

Figure 4:
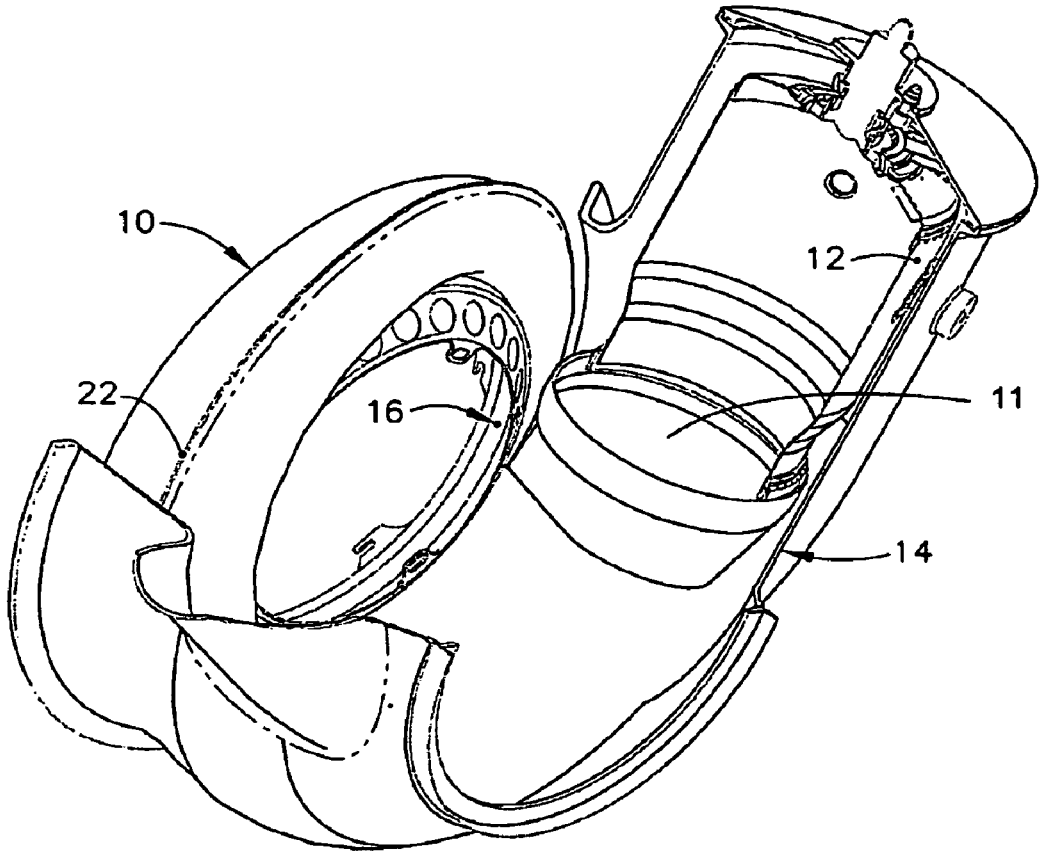
FIG. 4 is a partially cut-away view of the combustion system of the present invention.

Referring to FIGS. 3 and 4, there is shown a partially cut-away view of the combustion system of the present invention. Fabrication of turbine scroll 10 may be accomplished by forming a thin sheet of metal. The open ends of the scroll may be welded to machined rings (not shown) that control air leakage at the turbine scroll 10/combustor housing 14 junction as well as at the turbine scroll 10/B-width combustion exhaust product discharge area 16. A joining line 22 is shown as the location where the material may be joined in the turbine scroll manufacturing process. Joining line 22 is bent toward the outward edge of turbine scroll 10 to allow manufacturing to clamp the edges to hold its form during the welding process. Joining line 22 is shown in FIG. 3 to show how the outward edge of turbine scroll 10 is offset down the helix of turbine scroll 10 at axial shift region 18.

While the above describes fabrication of turbine scroll 10 by forming a thin sheet of metal, any method known in the art may be employed. For example, turbine scroll 10 may be fabricated from a casting process with the machined rings that control air leakage being integral with turbine scroll 10.

It should be understood, of course, that the foregoing relates to preferred embodiments of the invention and that modifications may be made without departing from the spirit and scope of the invention as set forth in the following claims.

We claim:

1. A turbine scroll of a turbine engine comprising:

a combustion exhaust inlet;

a combustion exhaust product discharge area defining a B-width; and an axial shift region providing a portion of said turbine scroll to have a irregular cross-sectional area centroid passing beyond said B-width;

wherein said turbine scroll has a helical configuration.

2. A turbine scroll of a turbine engine comprising:

a combustion exhaust inlet;

a combustion exhaust product discharge area defining a B-width; and an axial shift region providing a portion of said turbine scroll to have a irregular cross-sectional area centroid passing beyond said B-width;

wherein said turbine scroll has a helical configuration and wherein said irregular cross-sectional area has a flat curve portion curving around said helical configuration.

3. The turbine scroll of claim 2, wherein said combustion exhaust inlet is at the same azimuthal angle along said helical configuration as said combustion exhaust product discharge area.

4. The turbine scroll of claim 2, wherein said turbine scroll has a conical shape with a cross-sectional area decreasing from said combustion exhaust inlet to said combustion exhaust product discharge area.

5. The turbine scroll of claim 4, wherein said combustion exhaust inlet is at the same radial angle along said helical configuration as said combustion exhaust product discharge region.

6. The turbine scroll of claim 2, wherein said turbine scroll is attached to a combustor liner of said turbine engine.

7. The turbine scroll of claim 2, further comprising a joining line, said joining line being located along an outer perimeter of said turbine scroll.

8. The turbine scroll of claim 2, wherein said turbine engine is an engine of an aircraft.

9. The turbine scroll of claim 2 wherein said B-width is axially shifted.

10. A turbine scroll of a turbine engine comprising:

a combustion exhaust inlet;

a combustion exhaust product discharge area defining a B-width; and an axial shift region providing a portion of said turbine scroll to have an irregular cross-sectional area centroid passing beyond said B-width; wherein said turbine scroll has a helical configuration;

said turbine scroll has a conical shape with a cross-sectional area decreasing from said combustion exhaust inlet to said combustion exhaust product discharge area; and said irregular cross-sectional area has a flat curve portion curving around said helical configuration.

11. The turbine scroll of claim 10, wherein said combustion exhaust inlet is at the same azimuthal angle along said helical configuration as said combustion exhaust product discharge area.

12. The turbine scroll of claim 10, wherein said turbine scroll is attached to a combustor liner of said turbine engine, said turbine engine being a turbine engine of an aircraft.

13. The turbine scroll of claim 10 wherein said B-width is axially shifted.

14. A turbine engine comprising a turbine scroll having a combustion exhaust inlet; a combustion exhaust product area defining a B-width; and an axial shift region providing a portion of said turbine scroll to have a cross-sectional area centroid passing beyond said B-width, wherein said combustion scroll has a helical configuration.

15. A turbine engine comprising a turbine scroll having a combustion exhaust inlet; a combustion exhaust product area defining a B-width; and an axial shift region providing a portion of said turbine scroll to have a cross-sectional area centroid passing beyond said B-width, wherein said combustion scroll has a helical configuration;

said turbine scroll has a conical shape with a cross-sectional area decreasing from said combustion exhaust inlet to said combustion exhaust product discharge area; and said cross-sectional area has a flat curve portion curving around said helical configuration.

16. The turbine engine of claim 15, wherein said combustion exhaust inlet is at the same azimuthal angle along said helical configuration as said combustion exhaust product discharge area.

17. The turbine scroll of claim 15 wherein said B-width is axially shifted.

18. A turbine engine comprising a turbine scroll having a combustion exhaust inlet; a combustion exhaust product area defining a B-width; and an axial shift region providing a portion of said turbine scroll to have a cross-sectional area centroid passing beyond said B-width, wherein said combustion scroll has a helical configuration;

a combustor housing, said combustor housing forming a cavity containing said turbine scroll, wherein said axial shift region occupies a previously empty space in said cavity.

19. A turbine engine comprising a turbine scroll having a combustion exhaust inlet; a combustion exhaust product area defining a B-width; and an axial shift region providing a portion of said turbine scroll to have a cross-sectional area centroid passing beyond said B-width, wherein said combustion scroll has a helical configuration;

wherein said turbine scroll is attached to a combustor liner of said turbine engine, said turbine engine being a turbine engine of an aircraft.

20. A turbine engine comprising a turbine scroll having a combustion exhaust inlet, a combustion exhaust product discharge area defining a B-width, and an axial shift region providing a portion of said turbine scroll to have an irregular cross-sectional area centroid passing beyond said B-width, wherein said turbine scroll has a helical configuration;

said turbine scroll has a substantially conical shape with a cross-sectional area decreasing from said combustion exhaust inlet to said combustion exhaust product discharge area; and said irregular cross-sectional area has a flat curve portion curving around said helical configuration.

21. The turbine engine of claim 20, wherein:

said combustion exhaust inlet is at the same azimuthal angle along said helical configuration as said combustion exhaust product discharge area; and said turbine engine is a turbine engine of an aircraft.

22. The turbine scroll of claim 20 wherein said B-width is axially shifted.

23. A method for making a turbine engine comprising:

attaching a first, combustion exhaust inlet end of a turbine scroll to a combustor liner of said turbine engine;

attaching a second, opposite end of said turbine scroll to a combustion exhaust product discharge area defining a B-width;

providing an axial shift region in said turbine scroll, said axial shift region resulting in a portion of said turbine scroll having an irregular cross-sectional area centroid passing beyond said B-width; and shaping said turbine scroll in a helical configuration.

24. A method for making a turbine engine comprising:

attaching a first, combustion exhaust inlet end of a turbine scroll to a combustor liner of said turbine engine;

attaching a second, opposite end of said turbine scroll to a combustion exhaust product discharge area defining a B-width;

providing an axial shift region in said turbine scroll, said axial shift region resulting in a portion of said turbine scroll having an irregular cross-sectional area centroid passing beyond said B-width; and shaping said turbine scroll in a helical configuration; and forming said irregular cross-sectional area with a flat curve portion curving around said helical configuration.

25. The method for making a turbine engine of claim 24, further comprising shaping said turbine scroll has a conical shape with a cross-sectional area decreasing from said combustion exhaust inlet to said combustion exhaust product discharge area.

26. The method for making a turbine engine of claim 25, further comprising locating said combustion exhaust inlet at the same azimuthal angle along said helical configuration as said combustion exhaust product discharge area.

27. The method for making a turbine engine of claim 24, further comprising:

providing a combustor housing to form a cavity containing said turbine scroll; and locating said axial shift region in a space in said cavity that was previously unoccupied, thereby requiring no additional increase in size of said cavity to accommodate said turbine scroll having said axial shift region.

28. The method for making a turbine engine of claim 24 wherein said B-width is axially shifted.

* * * * *